US010178919B2

(12) United States Patent
Doyle

(10) Patent No.: US 10,178,919 B2
(45) Date of Patent: Jan. 15, 2019

(54) WOVEN PICTURE FRAME AND METHOD OF USE

(71) Applicant: Peter Doyle, San Luis Obispo, CA (US)

(72) Inventor: Peter Doyle, San Luis Obispo, CA (US)

( * ) Notice: Subject to any disclaimer, the term of this patent is extended or adjusted under 35 U.S.C. 154(b) by 93 days.

(21) Appl. No.: 15/289,185

(22) Filed: Oct. 9, 2016

(65) Prior Publication Data

US 2017/0099963 A1 Apr. 13, 2017

Related U.S. Application Data

(60) Provisional application No. 62/239,398, filed on Oct. 9, 2015.

(51) Int. Cl.

| | |
|---|---|
| ***A47G 1/10*** | (2006.01) |
| ***A47G 1/06*** | (2006.01) |
| ***B44C 5/02*** | (2006.01) |

(52) U.S. Cl.

CPC ..... *A47G 1/0616* (2013.01); *A47G 1/0644* (2013.01); *B44C 5/02* (2013.01)

(58) Field of Classification Search

CPC ..... A47G 1/0627; A47G 1/0644; A47G 1/10
USPC ..... 40/782, 783, 798, 799; 434/83, 95; D6/300

See application file for complete search history.

(56) References Cited

U.S. PATENT DOCUMENTS

| | | | | |
|---|---|---|---|---|
| 3,038,272 | A * | 6/1962 | Colston | A47G 7/02 40/732 |
| 3,748,706 | A | 7/1973 | Doyel | |
| 3,883,975 | A | 5/1975 | Mentken | |
| 4,117,614 | A | 10/1978 | Bickford | |
| 4,211,023 | A * | 7/1980 | Eubank, Jr. | A47G 1/0644 248/490 |
| 5,579,596 | A | 12/1996 | Kovacs | |
| D413,732 | S * | 9/1999 | French | D6/300 |
| 2014/0000140 | A1 | 1/2014 | Fredette | |

* cited by examiner

*Primary Examiner* — Joanne Silbermann
(74) *Attorney, Agent, or Firm* — SoCal IP Law Group LLP; Guy Cumberbatch

(57) ABSTRACT

An adjustably-sized and shaped picture frame formed of corner pieces around which are looped or woven one or more filaments such as colored yarns to form the frame borders. The frames created can be customized to various shapes and sizes. The corner pieces may be molded or molded and machined, and may have a diamond shape with inner side edges that align with outer corners of a sheet of artwork. The filament is woven around posts on both a front face and an outer corner of the corner pieces. A chamfer under a lower face of each corner piece may be used to secure free ends of the filament.

22 Claims, 9 Drawing Sheets

WOVEN PICTURE FRAME AND METHOD OF USE

RELATED APPLICATIONS

The present application claims priority under 35 U.S.C. § 119 to U.S. Provisional Application No. 62/239,398, filed Oct. 9, 2015.

FIELD OF THE INVENTION

This disclosure relates to a picture frame and, more particularly, to an assembly of frame corners used to rapidly create a woven frame of variable sizes.

BACKGROUND OF THE DISCLOSURE

Parents of small children are frequently faced with a conundrum of what to do with various pieces of artwork produced at school, camps, and the like. Some of the artwork is highly sentimental and even beautiful, but what to do with the sheer volume of such works becomes daunting. Ideally the best works will be framed and displayed, although finding the right-sized frames is often an obstacle, and the cost of procuring custom frames is typically prohibitive.

Consequently, there is a need for a quick, easy and inexpensive means for creating frames for odd-shaped and/or sized artwork.

SUMMARY OF THE INVENTION

The present application discloses an adjustably-sized and shaped picture frame formed of corner pieces around which are looped one or more filaments such as colored yarns to form the frame borders.

DETAILED DESCRIPTION

FIGS. 1A-1D show a sequence of forming a rectangular picture frame using four corner pieces 20 as disclosed herein. It should be understood that the frames created by using the structures and methods herein can be in various shapes and sizes. For instance, the four corners of a conventional rectangular frame can be modified to be square. Or, the shape may be any number of polygons with corners or apices, such as a hexagon, octagon, triangle, etc. Further, the size of the frame may vary from extremely small, limited only by the size of the corner pieces, to as large as the display space permits. As will be seen, the borders of the frame are formed by looping filaments such as yarn around the shape defined by the corners, and the type of filaments may vary as well. Conventional colored yarns may be used for smaller frames while materials such as cable, fishing line, even chain may be used. The distance between the corners may require some tension in the filament to avoid sagging, but the choice of material and construction of the corners may enable relatively large frames to be created, even wall-sized.

Exemplary corner pieces 20 will be described in more detail below with reference to FIGS. 2-3, but each is a separate, preferably molded, element that includes structure for securing it to a wall or other display surface. Each corner pieces 20 includes a plurality of notches for looping filamentary material such that an extended length (or multiple lengths) of such filament may be woven around and around the corners to define the borders of the frame. The corner pieces 20 are desirably molded plastic with the notches formed between small studs or posts, though as mentioned the material may vary depending on the need.

Figure 1A:
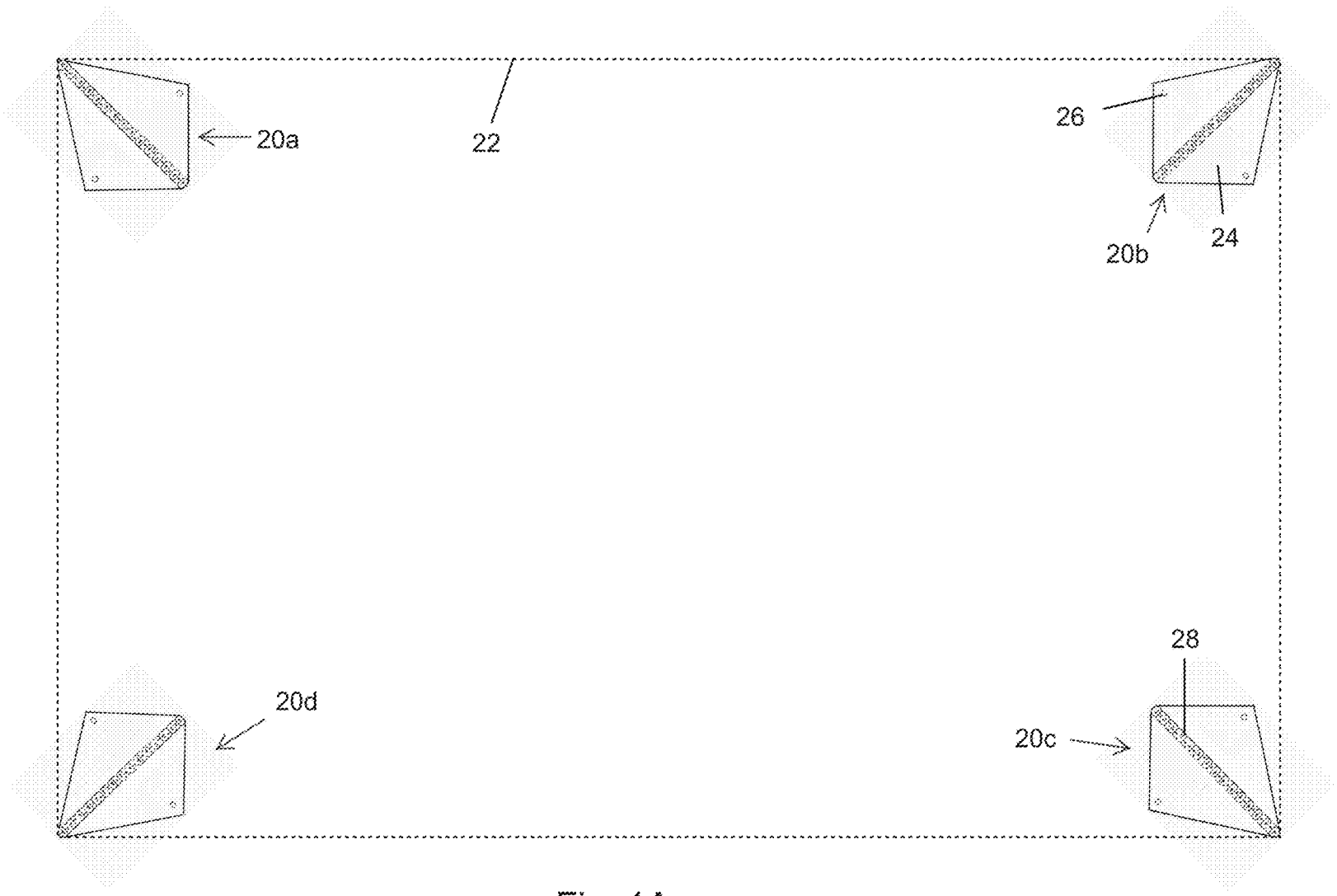
FIGS. 1A-1D show a sequence of forming a rectangular picture frame using four corner pieces as disclosed herein.

With reference to FIG. 1A, four corner pieces 20*a*, 20*b*, 20*c*, and 20*d* are shown arrayed in a rectangular pattern 22. The rectangular pattern 22 may represent a rectangular piece of artwork or photograph being framed. In order to properly locate and orient the corner pieces 20 within the rectangular pattern 22, a mounting template (not shown) may be provided.

Each corner piece 20 has a solid body 24 on which is provided at least one and preferably at least two mounting holes 26. In the exemplary embodiment, the body 24 of each corner piece 20 defines a diamond shape with a long dimension oriented at 45° to the corners of the rectangular pattern 22, and a short dimension perpendicular thereto. An aligned series of front posts 28 stick outward (relative to the display surface) from the body 24 and provide notches 29 (FIG. 2B) therebetween around which the filament may be looped. It should be noted that at least in the illustrated embodiment the two inner side edges of the body 24 that face inward relative to the rectangular pattern 22 are oriented at 0° and 90° from the horizontal, which assists in manually mounting the corner pieces 20.

Figure 1B:
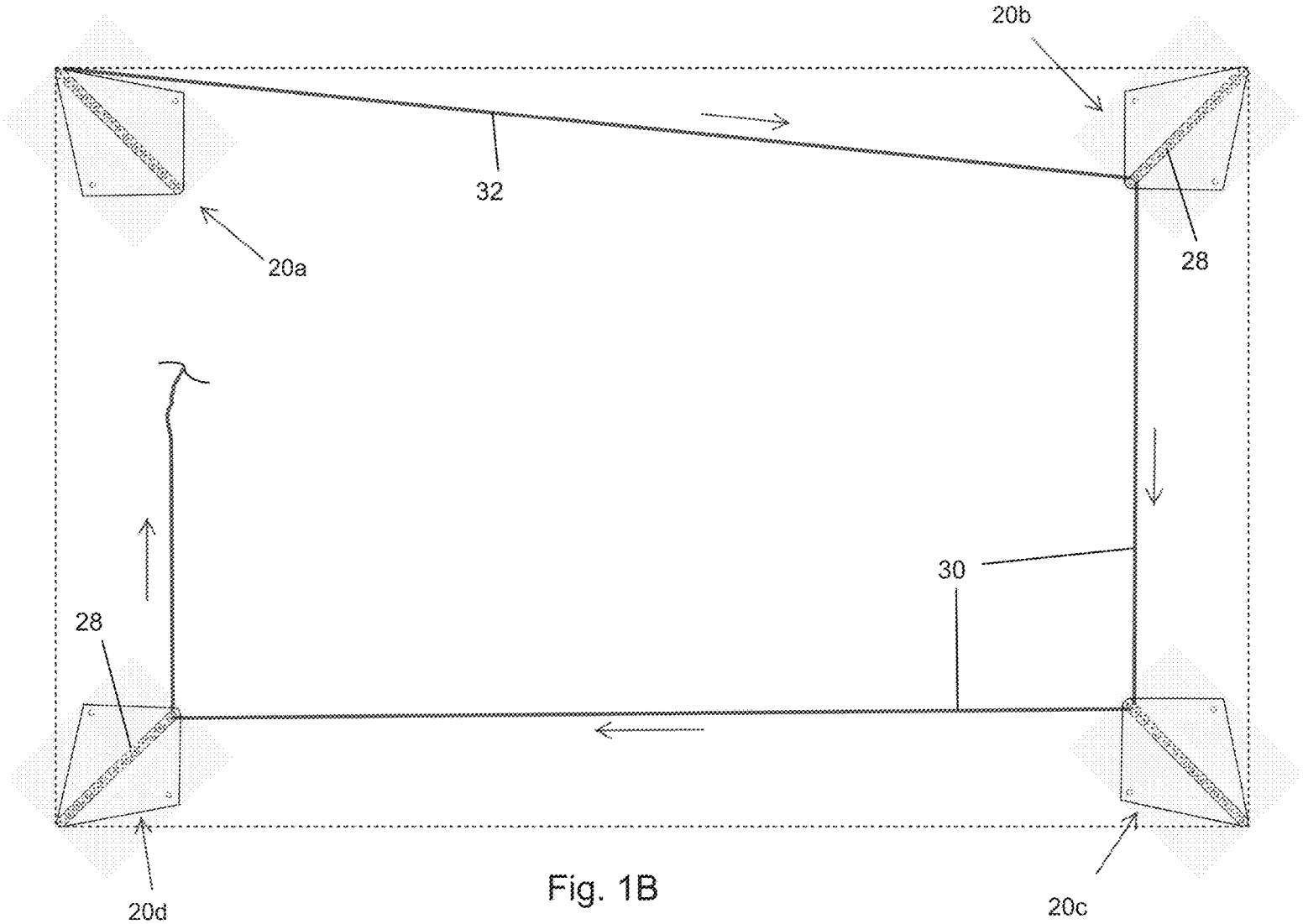

FIG. 1B shows a length of filament 30 (such as yarn) extending in a first segment 32 diagonally inward from the corner piece 20*a* on the upper left, around a front post 28 on the next corner piece 20*b* in a clockwise direction, then around the next corner piece 20*c*, and finally around the fourth corner piece 20*d*, with the arrows indicating the weaving path. As will be shown below, each corner piece 20 has a small chamfer on the backside of an outer corner which may be used to secure a knotted free end of the filament 30. From there, the filament 30 loops around the innermost front post 28 on each corner piece 20.

Figure 1C:
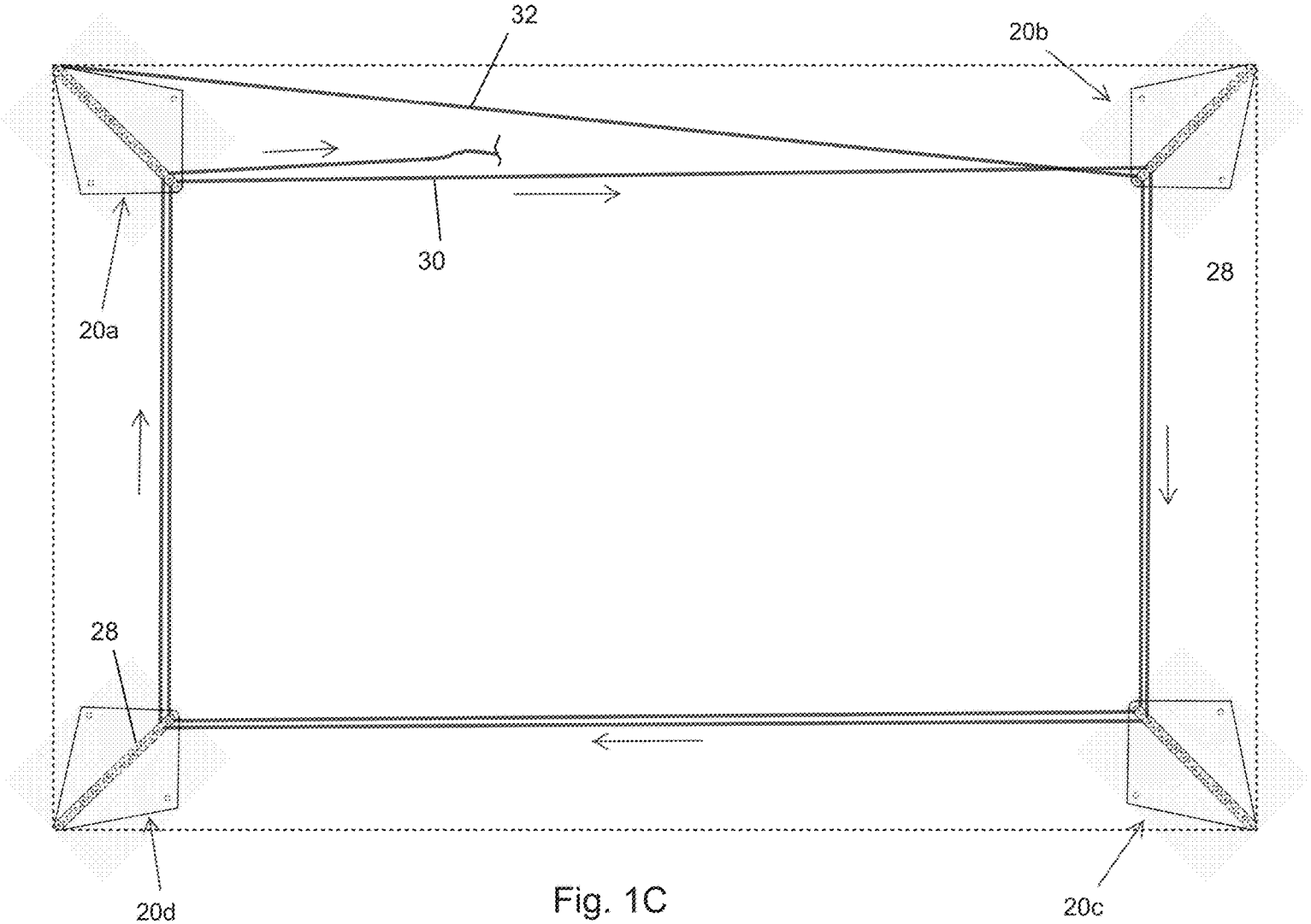

FIG. 1C shows a further progression of forming the frame wherein the filament 30 has been sequentially looped around the next outward front post 28 on each of the corner pieces 20*a*, 20*b*, 20*c*, and 20*d*, according to the arrows. The weaving continues until the filament 30 has been looped around each one of the front posts 28 on the corner pieces 20, progressing outward one post at a time. In this progression, the first segment 32 is eventually concealed by the successive wrappings of the filament 30 up the front posts 28 on each corner piece 20.

Figure 1D:
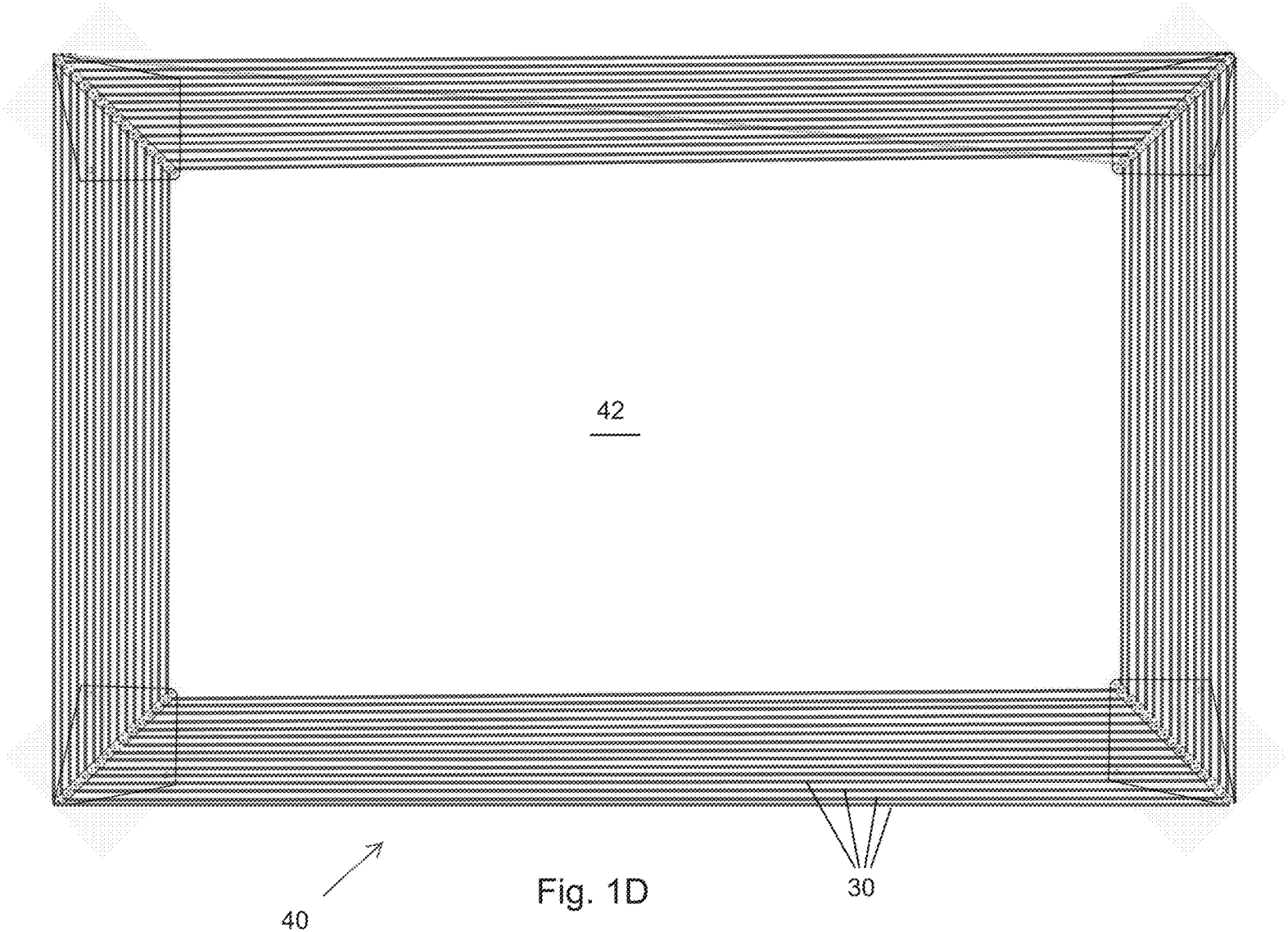

FIG. 1D shows the filament 30 wrapped around all of the front posts 28 on the front face of the four corner pieces 20 so that a frame 40 is created around an inner area 42 in which can be seen the artwork. The front borders of the frame 40 are formed by the filament 30 looped around the front posts 28. As will be explained below, the filament 30 is desirably also wrapped around the outer sides of the corner pieces 20 so as to create a three-dimensional frame.

Figure 2A:
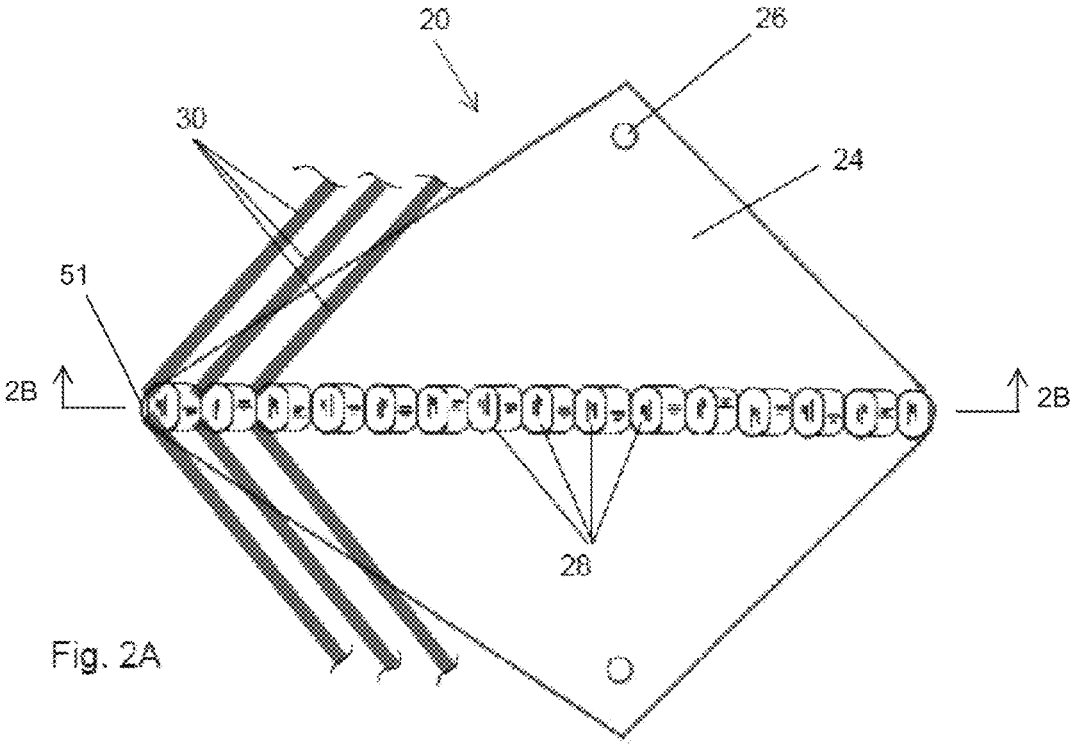
FIGS. 2A and 2B are plan and sectional views of an exemplary corner piece of the present application showing a partial weave of filament.
Figure 2B:
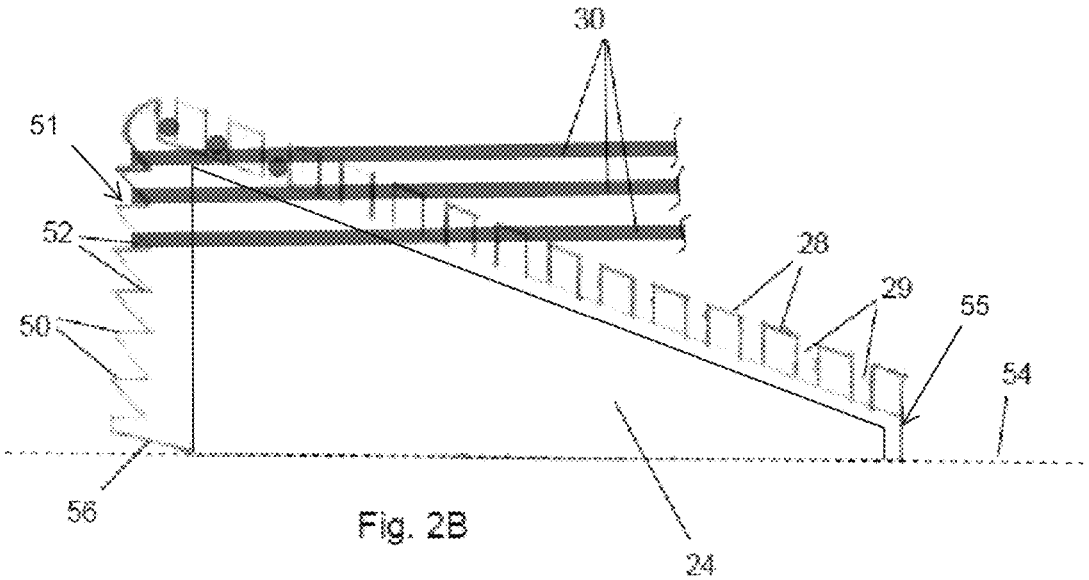

FIGS. 2A and 2B are plan and sectional views of an exemplary corner piece 20 showing a partial weave of filament 30. After wrapping around all of the front posts 28 on the front faces of the corner pieces 20, the filament 30 is wrapped further around the corner posts 50 on outer corner edges 51 of each of the corner pieces 20, as seen in FIG. 2B. The filament 30 is wrapped starting at a notch 52 defined by a corner post 50 farthest away from a mounting surface 54, and then successively around notches between the posts toward the mounting surface. Ultimately, the corner edge 51 of each of the corner pieces 20 is covered by the filament 30 and the filament may be secured by wrapping it under the small chamfer 56, and then around the same or adjacent corner pieces/chamfers as needed to secure. The shape of the small chamfer 56 permits the filament 30 to be wedged between the corner piece 20 and the mounting surface 54. Wrapping the filament 30 in this manner essentially conceals the corner pieces 20 on the sides of the frame, which is now three-dimensional. Depending on the thickness of the filament, each post 28, 50 may be wrapped one or more times.

It should be noted that the corner pieces 20 are generally triangular in cross-section, as seen in FIG. 2B, with the outer corner edge 51 extending farther out from the mounting surface 54 than an inner corner edge 55. The outer frame 40 thus creates depth for the framed inner area 42 (FIG. 1D), as common picture frames do. The frame 40 may be colorful and whimsical such as by using yarn of one or more colors, or monochromatic and industrial such as by using steel cable, black fishing line or the like. The variety of looks are endless.

Figure 3A:
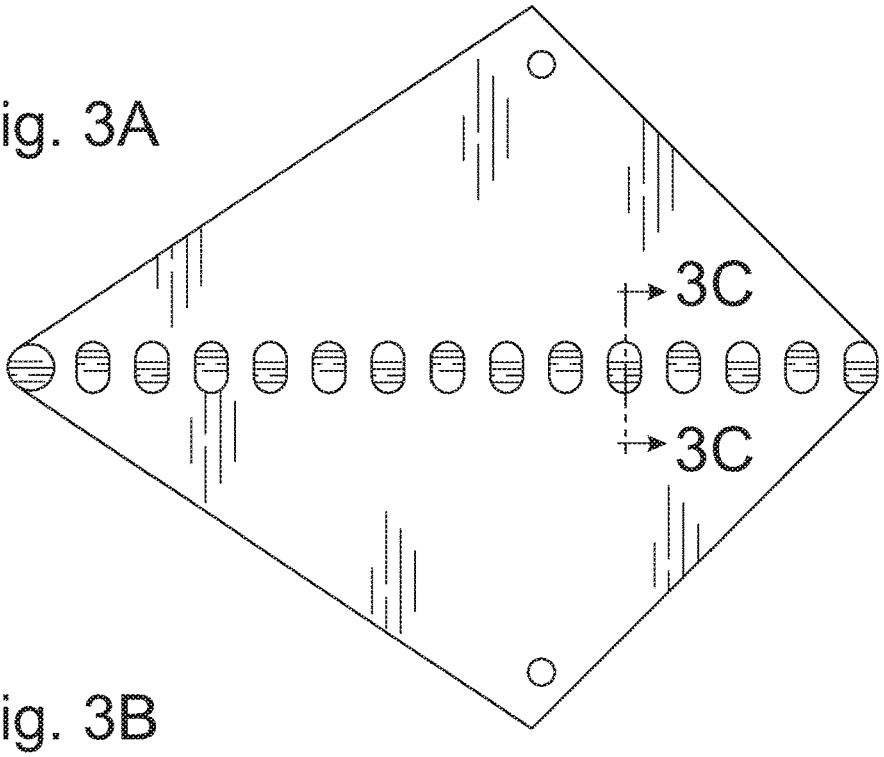
FIGS. 3A-3C are plan, sectional and detailed views of the exemplary corner piece showing example dimensions.
Figure 3B:
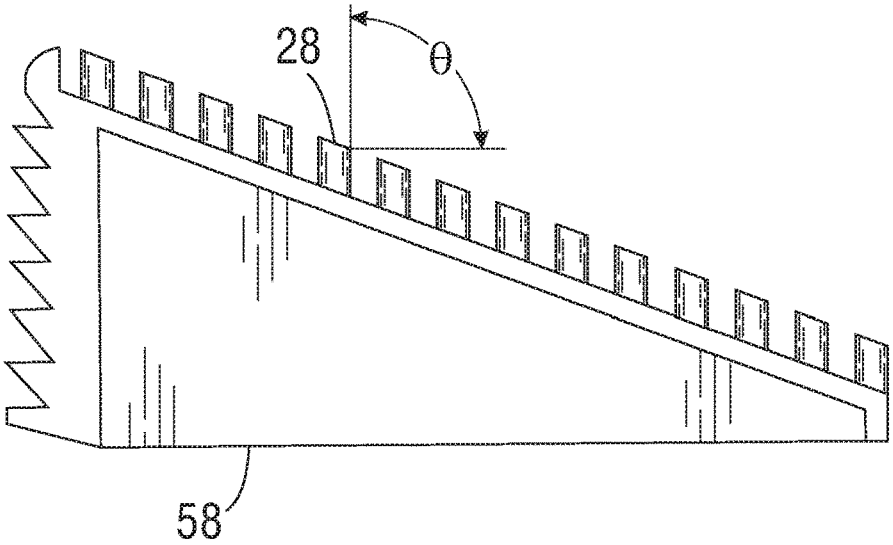
Figure 3C:
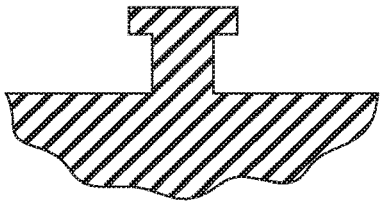

FIGS. 3A-3C are plan, sectional and detailed views of the exemplary corner piece showing example dimensions. Preferably an underside of the corner pieces 20 is hollow defining a cavity 58 to reduce weight, preferably such that a ¼ inch perimeter remains. The exemplary corner piece 20 lies flush against the mounting surface 54, and thus is especially suitable for framing sheets of paper. Alternatively, an indented inner corner (not shown) on each piece 20 may be provided to hold a sheet of glass.

FIG. 3B illustrates an angle θ that the front posts 28 make with the horizontal, or with the mounting surface to which the corner pieces are secured. Preferably, the angle θ is at least 90°, and more preferably the angle is slightly greater than 90°, such as between about 93-94°. Angling the posts 28 in this manner helps prevent the filament 30 from slipping off during the weaving process and after. In some instances, a small amount of adhesive may be applied to the outer surface of the posts 28 to further help secure the filament 30 thereto.

One option is to supply small lights such as LEDs to the corner pieces 20 that shine inward toward the framed area 42. The light may be raised up on one of the posts 28.

Figure 4A:
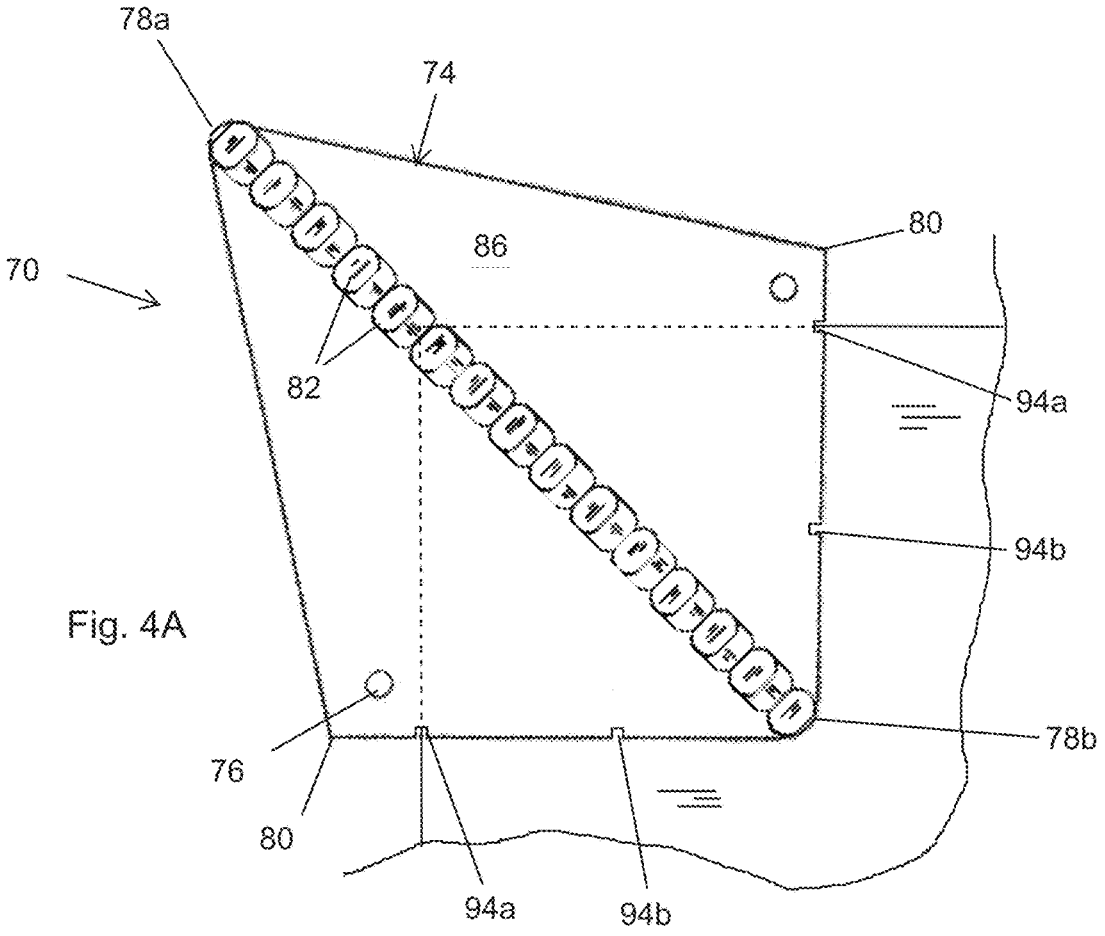
FIGS. 4A and 4B are plan and elevational views of another exemplary corner piece of the present application.
Figure 4B:
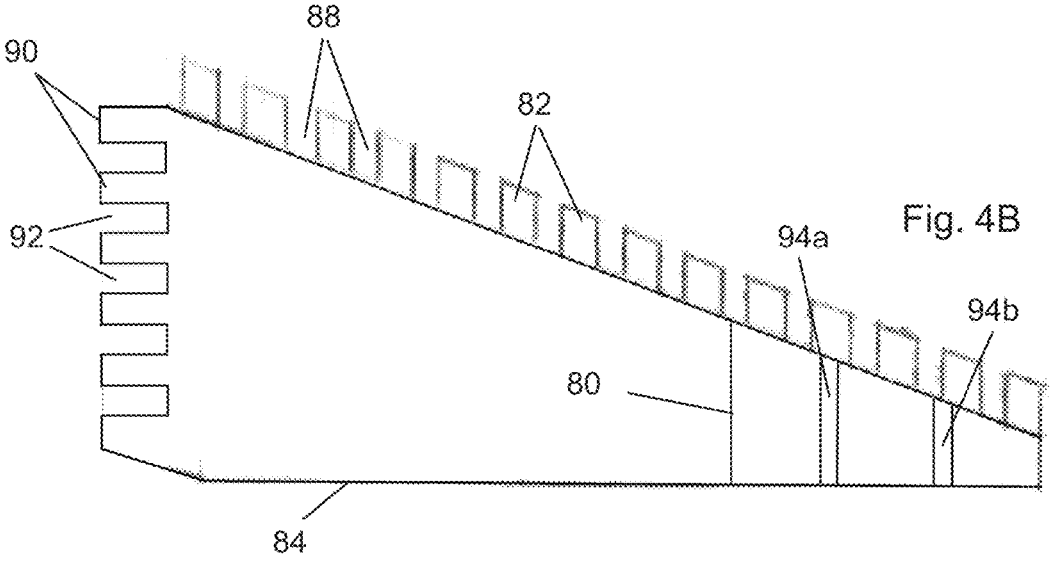

FIGS. 4A and 4B are plan and elevational views of another exemplary corner piece 70 of the present application. As in the first embodiment, each corner piece 70 has a solid (preferably molded) body 74 on which is provided at least one and preferably at least two mounting holes 76. In the exemplary embodiment, the body 74 defines a diamond shape with a long dimension between outer and inner corner edges 78*a*, 78*b* and a short dimension perpendicular thereto and extending between intermediate corner edges 80. An aligned series of front posts 82 stick outward relative to a flat lower face 84 from an angled upper face 86 of the body 74 and provide notches 88 therebetween around which the filament(s) may be looped.

In contrast to the first embodiment, the outer corner edge 78*a* features a series of generally rectangular side posts 90 defining notches 92 therebetween. Although the posts 90 and notches 92 may be defined during the molding process using a sliding mold, they may also be machined after forming the rest of the corner piece 70.

FIGS. 4A and 4B also illustrate four alignment notches 94*a*, 94*b* that are formed on the perpendicular inner sides of the corner piece 70. Each pair of notches 94*a*, 94*b* is positioned equidistant from the inner corner edge 78*b* so as to enable the corner piece 70 to be aligned with a rectangular (or square) piece of artwork. For example, the corner piece 70 is shown positioned over a corner of rectangular sheet of art 96. By aligning the adjacent perpendicular edges of the sheet of art 96 with the outer pair of notches 94*a*, as shown, the corner piece 70 is easily aligned with the corners of the artwork. At this point, the corner piece 70 is then secured to the mounting surface with nails or other such fasteners through the mounting holes 76.

Figure 5:
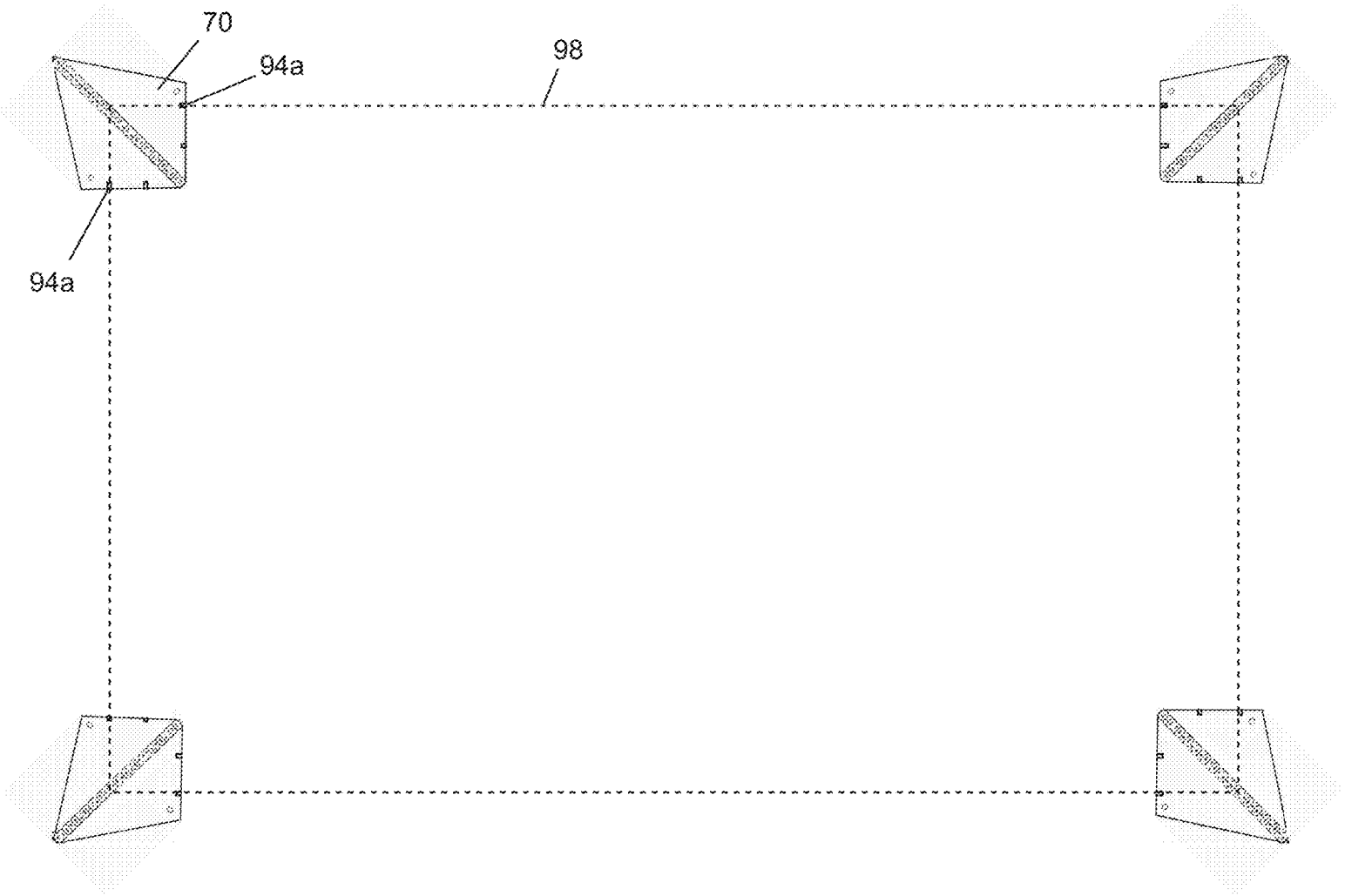
FIG. 5 shows a first step in forming a rectangular picture frame using the corner pieces of FIGS. 4A and 4B.

FIG. 5 shows a first step in forming a rectangular picture frame using the corner pieces 70 of FIGS. 4A and 4B. A rectangular outline 98 indicates the border of a sheet of art that will be framed. Each one of the corner pieces 70 is first aligned with the corners of the outline 98 by using the alignment notches 94. After fastening down all of the corner pieces 70, the aforementioned weaving process can be implemented to form a frame such as shown in FIG. 1D.

Figure 6A:
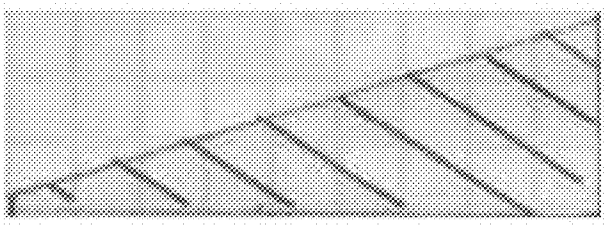
FIGS. 6A-6F schematically illustrate alternative cross-sectional shapes for the corner pieces disclosed herein.
Figure 6B:
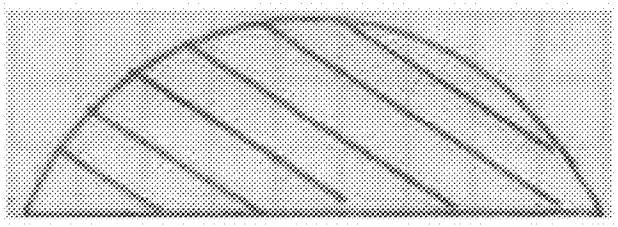
Figure 6C:
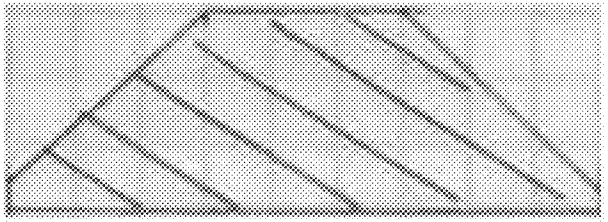
Figure 6D:
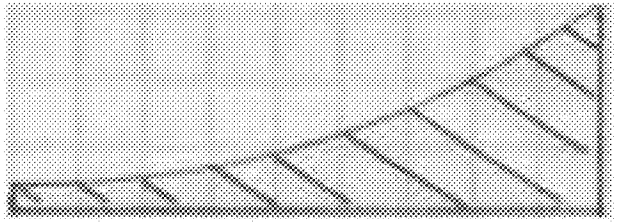
Figure 6E:
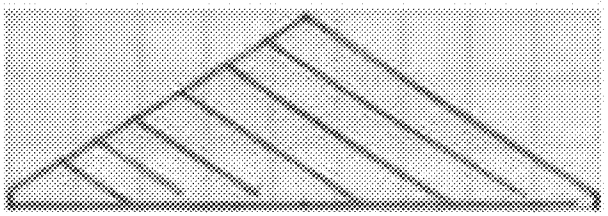
Figure 6F:
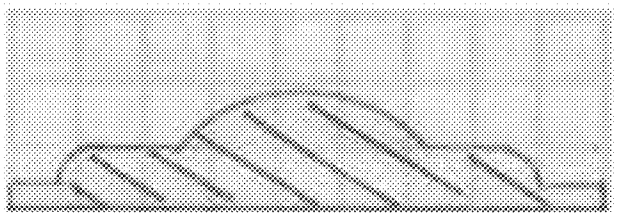

FIGS. 6A-6F schematically illustrate alternative cross-sectional shapes for the corner pieces disclosed herein. It should be understood that the posts around which the filaments may be weaved are not shown in these views. FIG. 6A is a generally triangular or tapered cross-section as previously described. FIG. 6B shows a rounded or semicircular corner piece cross-section which results in a pillow-like appearance once the filaments are weaved around them. FIG. 6C illustrates a truncated pyramid or generally trapezoidal shape. FIG. 6D shows a concave ramp shape. FIG. 6E illustrates a full pyramid shape. And finally, FIG. 6F illustrates a combination of rounded and flat edges. These are only a few of the possible configurations that can be utilized. Each corner piece is desirably provided in several sizes for framing small to large items, and forming send to wider frames.

As mentioned above, various filaments may be utilized to form the frames described herein. For example, colored yarns, metallic or polymeric cable or wire, fishing line, chain, string, thread, string beads, etc.

The following is a recap of the frame creation process: After placing the corner pieces in the corners, a filament is chosen and a knot tied in the end. The outside bottom of the corners has a slight ramp or chamfer, and as the yarn is pulled up one of the chamfers the knot catches, no matter what thickness of yarn is used. Once the filament has caught weaving starts at the inside stud or post of the next corner, to the CW or CCW direction.

If the filament is skinny it will need to wrap around each stud two or three times. If it is thick it is wrapped around each stud only once. This way, when all is done one can't see thru the frame. After wrapping around the last indent on the back outside edge the filament ends up where it started, though not necessarily on the same corner. At this point the filament is wrapped around that ramp a few more times, thus tucking the yarn under the outside back edge of a corner piece. The yarn is then cut, tucked in and the frame is complete. The whole process should take a few minutes.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

It is claimed:

1. A woven frame, comprising:

a) at least three corner pieces each having a rear face adapted to lie against a mounting surface, the at least three corner pieces being spaced apart around a framed area, each of the corner pieces having structure for fastening the corner piece to the mounting surface with the rear face against the mounting surface so that a front face opposite the rear face faces away from the mounting surface, and each corner piece defining front notches on the front face opposite the rear face; and b) one or more filaments woven over the front faces of the corner pieces and through the front notches of the corner pieces and around each of the corner pieces sequentially a plurality of times to produce a woven frame around a periphery of the framed area composed of a plurality of filaments between each two adjacent corner pieces.

2. The woven frame of claim 1, wherein there are four corner pieces configured to be arranged on the mounting surface such that the framed area is a rectangular area, each corner piece having a diamond shape with a long dimension oriented at 45° to the corners of the rectangular area and a short dimension perpendicular thereto.

3. The woven frame of claim 2, wherein each corner piece has a cross-sectional shape that tapers outward from the mounting surface from an inner corner edge to an outer corner edge.

4. The woven frame of claim 2, further including a pair of alignment notches formed in each of two inner side edges, the inner side edges being oriented 90° from each other such that the corner pieces may be aligned with 90° corners of a rectangular sheet being framed.

5. The woven frame of claim 1, wherein each corner piece has a thickness that projects away from the mounting surface and includes an outer corner edge, and further includes a plurality of front posts on the front face that define the front notches therebetween and a plurality of corner posts on the outer corner edge that define corner notches therebetween, and the one or more filaments are also woven through the corner notches.

6. The woven frame of claim 5, wherein the front posts are angled at least 90° relative to the mounting surface in a direction as measured away from the framed area.

7. The woven frame of claim 5, wherein the corner pieces are molded from a polymer with the front posts formed by the mold process, and the corner notches machined.

8. The woven frame of claim 1, wherein the corner pieces are molded from a polymer and have a hollow interior.

9. The woven frame of claim 1, wherein each corner piece has a chamfer on the rear face at an outer corner that provides a relief from the mounting surface into which a filament may be wedged.

10. The woven frame of claim 1, wherein each corner piece has a cross-sectional front shape selected from the group consisting of: triangular or tapered, rounded or semi-circular, truncated pyramid or trapezoidal, concave ramp, pyramidal, a combination of rounded and flat edges.

11. The woven frame of claim 1, wherein each corner piece has a thickness that projects away from the mounting surface and includes an outer corner edge, and further includes a plurality of corner notches on the outer corner edge, and the one or more filaments are also woven through the corner notches.

12. A method of forming a picture frame, comprising:

a) mounting at least three corner pieces with a rear face contacting a mounting surface around a framed area, each of the corner pieces having structure for fastening the corner piece to the mounting surface with the rear face against the mounting surface so that a front face opposite the rear face faces away from the mounting surface, and each corner piece defining front notches on the front face opposite the rear face; and b) weaving one or more filaments over the front faces of the corner pieces and through the front notches of the corner pieces and around each of the corner pieces sequentially a plurality of times to produce a woven frame around a periphery of the framed area composed of a plurality of filaments between each two adjacent corner pieces.

13. The method of claim 12, wherein there are at least four corner pieces.

14. The method of claim 12, wherein there are four corner pieces mounted to define a rectangular framed area, and wherein the filaments are weaved around the corners pieces a sufficient number of times to conceal the corner pieces as seen from a front view.

15. The method of claim 12, wherein each corner piece has a chamfer on the rear face that provides a relief from the mounting surface, the method including wedging a free end of the filament under the chamfer of one of the corner pieces, then weaving the filament in one direction around adjacent corner pieces until the frame is formed, and then wedging a second free end of the filament under the chamfer of another of the corner pieces.

16. The method of claim 12, wherein each corner piece has front posts on the front face that define the front notches therebetween, and an outer corner edge with a plurality of corner posts that define corner notches therebetween, and the filaments are woven through the front notches and the corner notches to form a three-dimensional frame.

17. The method of claim 16, wherein each corner piece has a diamond shape with a long dimension oriented at 45° to the corners of the rectangular framed area and a short dimension perpendicular thereto.

18. The method of claim 16, wherein each corner piece has a chamfer on the rear face that provides a relief from the mounting surface, the method including wedging a free end of the filament under the chamfer of one of the corner pieces, then weaving the filament in one direction around adjacent corner pieces until the frame is formed, the filament being woven first around the front posts of each corner piece and then around the corner posts of each corner piece, and then wedging a second free end of the filament under the chamfer of another of the corner pieces.

19. The method of claim 12, wherein each corner piece has alignment notches formed on an inner side edges, and the method includes aligning the alignment notches with a piece of artwork to be framed prior to mounting the corner piece to the mounting surface.

20. The method of claim 12, wherein there are four corner pieces mounted to define a rectangular framed area, and wherein each corner piece projects outward from the mounting surface and a single filament is wrapped sequentially around the four corner pieces to form a three-dimensional frame.

21. The method of claim 20, wherein each corner piece has a generally triangular cross-sectional shape with a front face that tapers away from the mounting surface toward an outer corner edge, and the outer corner edge extends generally perpendicular to the mounting surface.

22. The woven frame of claim 20, wherein each corner piece has a thickness that projects away from the mounting surface and includes an outer corner edge, and further includes a plurality of corner notches on the outer corner edge, and the one or more filaments are also woven through the corner notches.

* * * * *